United States Patent [19]

Epperson

[11] 4,058,971

[45] Nov. 22, 1977

[54] DIGITAL WRISTWATCH AND STOPWATCH

[75] Inventor: Ronald D. Epperson, Newport Beach, Calif.

[73] Assignee: Hughes Aircraft Company, Culver City, Calif.

[21] Appl. No.: 679,953

[22] Filed: Apr. 26, 1976

[51] Int. Cl.[2] ..... G04F 7/04; G04B 19/30

[52] U.S. Cl. ..... 58/39.5; 58/50 R; 58/74

[58] Field of Search ..... 58/44, 23 R, 39.5, 50 R, 58/74

[56] References Cited

U.S. PATENT DOCUMENTS

| | | | |
|---|---|---|---|
| 3,810,356 | 5/1974 | Fujita | 58/85.5 |
| 3,813,533 | 5/1974 | Cone et al. | 58/152 R |
| 3,939,640 | 2/1976 | Kahn | 58/50 R |
| 3,992,871 | 11/1976 | Numabe | 58/39.5 |

*Primary Examiner*—E. S. Jackmon
*Attorney, Agent, or Firm*—Fay I. Konzem; W. H. MacAllister

[57] ABSTRACT

A resettable interval timer in combination with, but functioning independently from a digital watch which provides horological information. The watch operates in two modes; the first mode displaying horological information on the display devices and the second or stopwatch mode displaying interval timing information on the display devices. In the watch mode the user can program which horological information he desires to be continuously displayed on the display devices, either hours, minutes, and seconds, or hours, minutes, and date. By depressing one of the watch push buttons the user can momentarily display month, date, and the A.M. or P.M. horological information on the display devices. A predetermined push button depression sequence can be used to reset the horological information. When a second push button is depressed a predetermined number of times within a defined time interval the watch enters the stopwatch mode. In the stopwatch mode the user can reset the interval timing counters to zero, start the interval timer, stop the interval timer, freeze the interval timing information currently on the display devices (split or lap time), return the counters to the interval timing mode, and finally return the watch to the watch mode.

2 Claims, 4 Drawing Figures

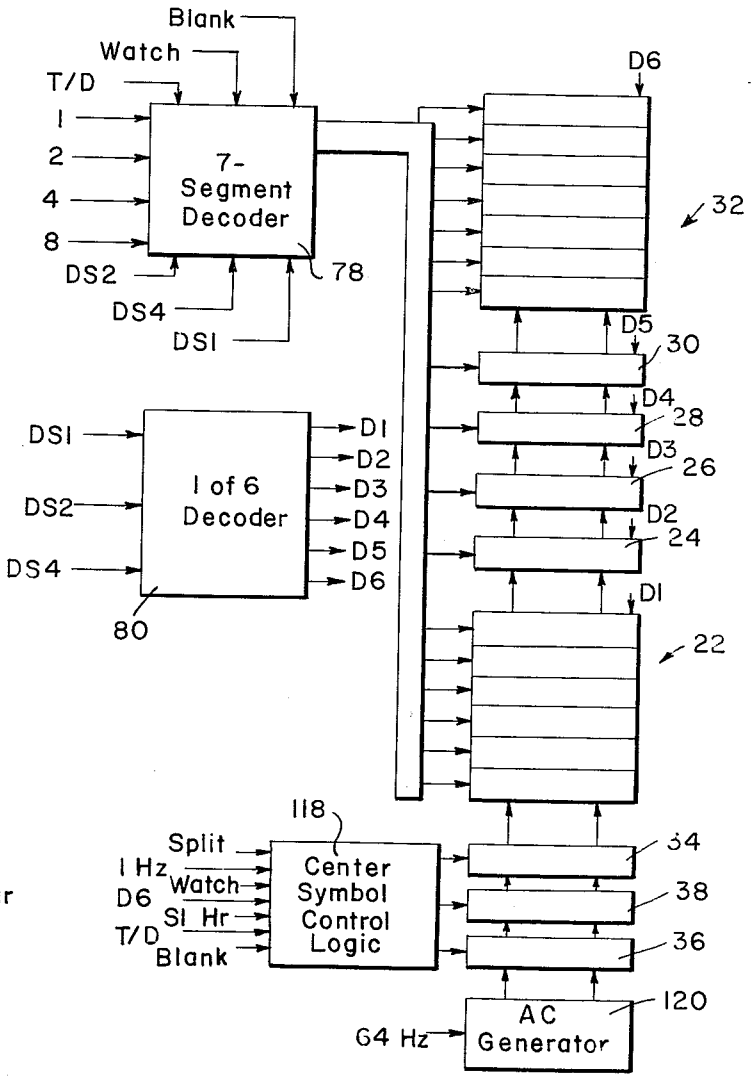
Fig. 4.
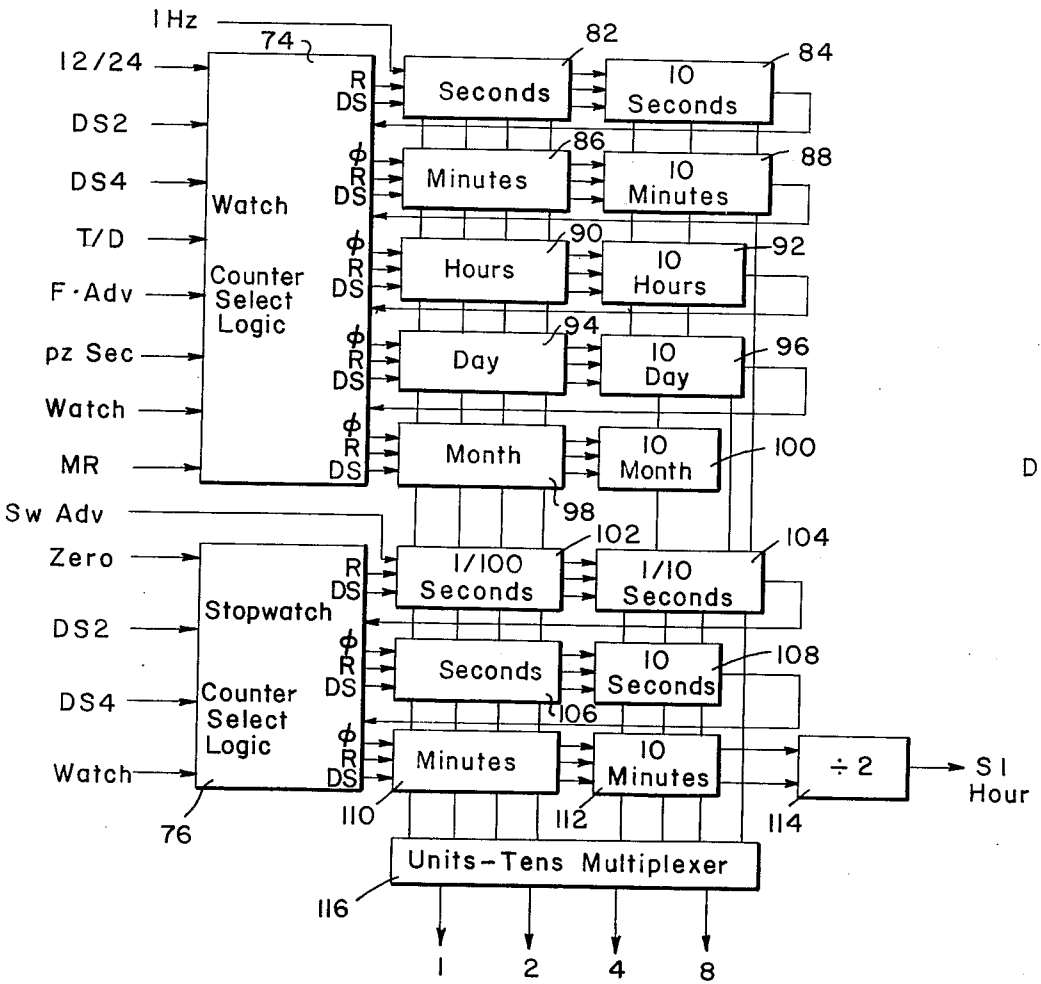

DIGITAL WRISTWATCH AND STOPWATCH

BACKGROUND OF THE INVENTION

1. Field of the Invention

This invention relates to digital electronic watches, and more particularly to a combination resettable interval timer and digital watch which provides horological information.

2. Description of the Prior Art

In the art, electronic stopwatches and digital watches have been used, but the present invention is a combination of a digital stopwatch and a digital watch for displaying horological information which allows the user to permanently and continuously program the horological counters to display either hours, minutes, and seconds, or hours, minutes, and date information on the display devices in combination with a stopwatch or interval timer which displays hours (in an odd/even format), minutes, seconds, and tenths and hundredths of seconds information on the same display devices.

SUMMARY OF THE INVENTION

The digital electronic watch, in accordance with the invention, consists of a resettable interval timer in combination with, but functioning independently from a digital watch which provides horological information. A plurality of push buttons control the watch control logic and the stopwatch control logic which cause the horological information and the interval timing information, respectively, to appear on the display devices. Also, watch counter select logic provide means for slewing the horological information in the watch mode.

Accordingly, it is an object of this invention to provide a combination digital watch and stopwatch with liquid crystal or other suitable display devices for continuously displaying horological information and for displaying selectable interval timing information.

It is another object to provide a digital watch with push buttons for displaying selectable horological and interval timing information on the display devices.

It is a further object to provide push buttons which when depressed in a particular sequence can freeze the interval timing information on the display devices.

The features of the present invention which are believed to be novel are set forth with particularity in the appended claims. The present invention, both as to its organization and manner of operation, together with further objects and advantages thereof, may be understood best by reference to the following description, taken in connection with the accompanying drawings.

A BRIEF DESCRIPTION OF THE DRAWINGS

FIG. 3 is a block diagram of the circuitry of the digital watch showing the watch counter select logic, the stopwatch counter select logic and the horological counters and the interval timing counters;

FIG. 4 is a block diagram of the circuitry of the digital watch showing the seven-segment decoder, the 1 of 6 decoder, the center symbol control logic and the liquid crystal display devices.

DETAILED DESCRIPTION

Figure 1:
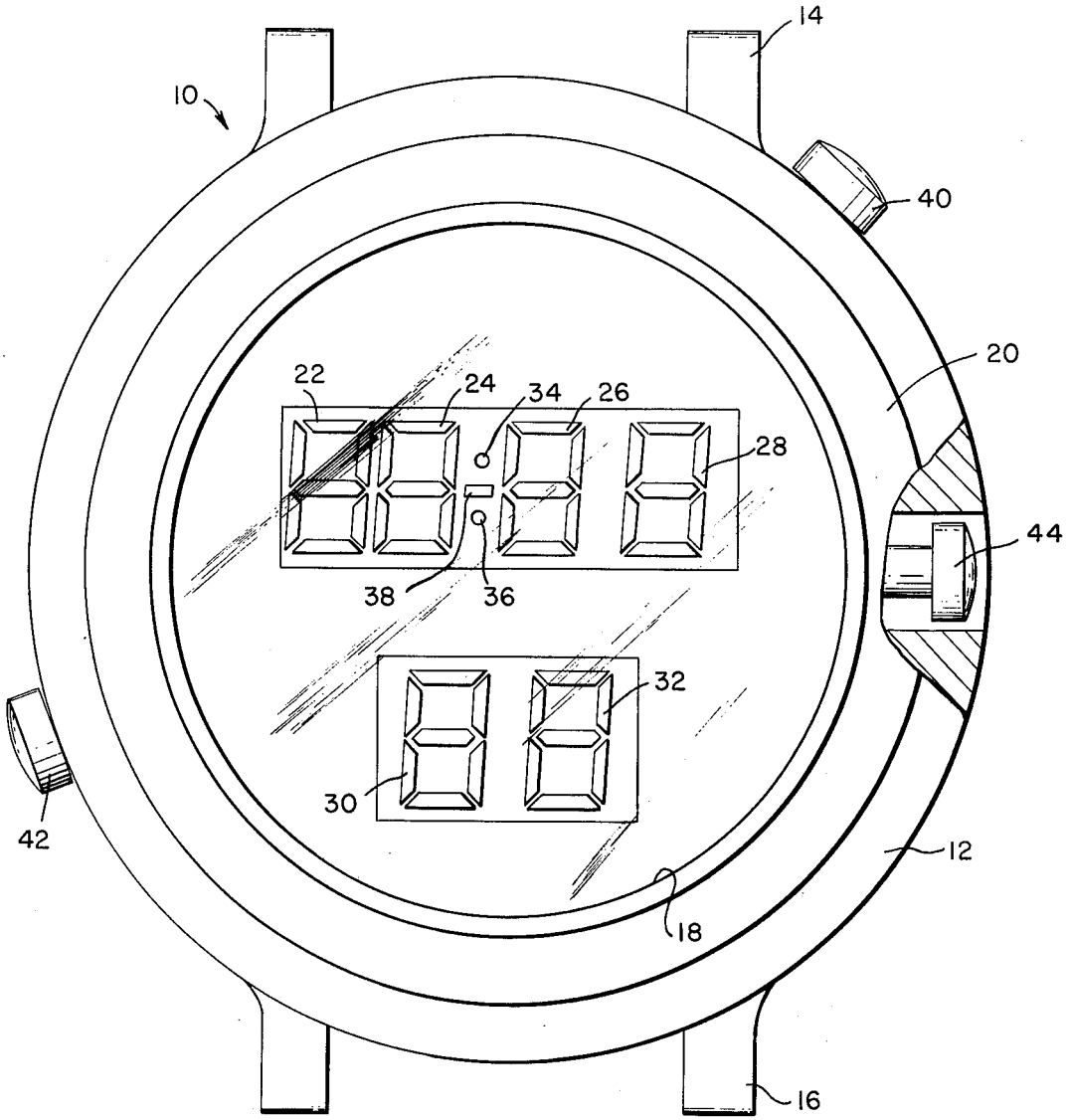
FIG. 1 is a top-plane view of the digital wrist watch/-stopwatch with liquid crystal display devices, in accordance with the present invention.

FIG. 1 shows digital watch 10 which has a case 12 which is provided with watch strap-securing ears 14 and 16. The securing ears 14 and 16 are of such nature that the digital watch strap can be attached thereon so that watch 10 can be carried upon the wrist of the wearer. In the preferred embodiment, the watch 10 is thus a wristwatch, although the same construction, curcuitry and display can be employed in a pocket watch. Crystal 18 is mounted in bezel 20 on the front of the watch.

Watch 10 has six liquid crystal watch display elements 22–32 which can remain visible continuously. Each of the display devices 24–32 is structured as a standard seven-segment liquid crystal display which is of such a nature that, when the selected segments are energized the 10 digits from 0–9 can be selectively represented. Device 22 has segments A and D tied together as it is only required to display the digits 0–5. Between liquid crystal display devices 24 and 26 are located dots 34 and 36 which can form a colon and bar or dash 38.

Watch case 12 carries manually operable push buttons 40 and 42, which are easily accessible. Furthermore, case 12 carries recessed push button 44 which can be depressed by a pointed object. On the digital watch/-stopwatch circuitry or chip (as shown in FIGS. 2–5) the manufacturer of the digital watch/stopwatch has a number of bonding options; that is, different information will be displayed on liquid crystal display devices 22–32 depending upon which connections are bonded to the watch circuitry. For example, the manufacturer of the watch has the option of making the watch either a 12 or 24 hour watch. The manufacturer also has the option of displaying the month on display devices 22 and 24 and the date on display devices 26 and 28 or the date on display devices 22 and 24 and the month on display devices 26 and 28; the former being the standard American way of reading the month and date information and the latter being the European method of reading this data, that is, the date first followed by the month information.

There are two basic modes; the watch or horological mode and second the stopwatch mode. In the normal display mode of the watch mode, (without any of the push buttons depressed) the hours information is displayed on display devices 22 and 24, the minutes information is displayed on devices 26 and 28 and the seconds information is displayed on devices 30 and 32. Also, in this mode the colon consisting of dots 34 and 36 will be activated.

When the user depresses push button 40 three times within two seconds the hours and minutes information will still be displayed on devices 22–28 but devices 30 and 32 will now display the date information. Therefore, the watch user who desires the date information to be continuously displayed instead of the seconds information can program his watch to do same by depressing push button 40 three times.

When push button 40 is depressed only once or twice within the two second timing period the watch will momentarily display the month information on display devices 22 and 24, date information on display devices 26 and 28 and either A. or P. on display device 32. Also, dash 38 will be displayed between devices 24 and 26 when the month, date, A.M./P.M. information is being displayed.

With the 24 hour embodiment, display device 32 will be blank since the A.M. and P.M. notation would have no significance. Releasing push button 40 returns the display devices to the hours, minutes, seconds/date mode. Any of the above-mentioned display modes are illuminated (which is advantageous in dim light with liquid crystal devices) when the light push button 42 is depressed.

By depressing the light push button 42 three times within 2 seconds the watch goes into the stopwatch mode, that is, the elapsing minutes information is displayed on devices 22 and 24, the elapsing seconds information is displayed on devices 26 and 28, the tenths and hundredths of seconds information is displayed on devices 30 and 32 and the minutes and seconds information are separated by bar 38 and dot 36. The bar and dot together resemble a "T" which stands for timing mode and shows that the watch is in the timing or stopwatch mode. When the stopwatch mode is entered by depressing push button 42 three times within 2 seconds the current status of the stopwatch is displayed. This could be the current running time if the stopwatch was left running when the watch mode was entered last or the stopped time, which could also be the reset state, if that was the condition of the stopwatch when the watch mode was last entered.

In the stopwatch mode push button 40 starts and stops the running of the timing information. If push button 40 is depressed a first time it starts the counter interval timer if it is depressed again push button 40 stops the counter and depressed a third time the interval timer will restart from where it was when it was stopped.

When the light push button 42 is depressed once in the stopwatch mode the current timer count is frozen on the display devices but the interval timer counters continue to run. If the light push button 42 is depressed twice within 2 seconds the display is unfrozen and returned to the running mode and displays the current advancing time. If push button 42 is depressed three times within two seconds the watch is returned to the normal watch mode, that is, the display devices display the hours, minutes and seconds information.

If push button 42 is depressed a first time the display devices will freeze the time, that is they will show the counting information time which was present when push button 42 was depressed but the counters will continue to count. That is, the time is frozen on the display devices at that instant but the counters continue to accumulate time. Each time push button 42 is depressed the updated timing information will be displayed; each single push of push button 42 will give you a new update of the display as the interval timer counters continue to count. If push button 42 is depressed twice within two seconds the display is unfrozen, instead of showing the frozen information it causes the display to go back and show the current counting information. Whenever the timing information is stopped by depressing push button 40, the watch will display the updated information. Finally, with regard to the functioning of the stopwatch mode, if the watch is in the "split" mode where the display information is frozen the center symbols (the dash 34 and the dot 36) will flash to indicate that the watch is in the "split mode."

Resetting the stopwatch to zero is accomplished by depressing both buttons 40 and 42. The stopwatch will remain reset until both pushbuttons are released and then button 40 is again depressed to start the stopwatch. Even and odd hours in the stopwatch mode are displayed on dot 34. This symbol will come on in the stopwatch mode after one hour has elapsed and thereafter will be on during odd hours and off during even hours. The operation of this symbol with respect to resetting and "splits" is the same as displays 22–28. Like displays 36 and 38, this symbol, if on, will flash during a split. Depressing pushbutton 42 three times within two seconds will cause the watch to go back to displaying hours, minutes, seconds/date. This will not affect the state on the mode of operation of the stop watch.

In order to set the watch, recessed pushbutton 44 is depressed. When pushbutton 44 is depressed a first time the display is set to month. On the display, the month and the dash 38 remain but the day and A.M. or P.M. information will be blank. Depressing bushbutton 40 causes selected displays to advance at a one hertz rate. A second push of the recessed pushbutton 44 blanks out all of the information except for the date information and the center dash 38. The third push of pushbutton 44 will blank all of the information except for the A.M. or P.M. information. In the 24 hour mode, the third push of pushbutton 44 defaults to the fourth push in the sequence as there is no A.M. or P.M. in a 24 hour mode. The fourth push of pushbutton 44 will blank all the information except for the hours information and the colon made up of 34 and 36. Depressing pushbutton 40 causes selected displays to advance at a one hertz rate. Depressing pushbutton 44 again, a fifth time, will cause all but the minutes and dots 34 and 36 to be blanked. Depressing pushbutton 40 momentarily resets the second counter to nearest $\frac{1}{8}$ seconds. Holding pushbutton 40 will cause the minutes to advance at a 2 hertz rate approximately three seconds after the button was pushed. Depressing pushbutton 44 a sixth time returns the watch to its primary display mode, that of hours, minutes, and seconds.

Figure 2:
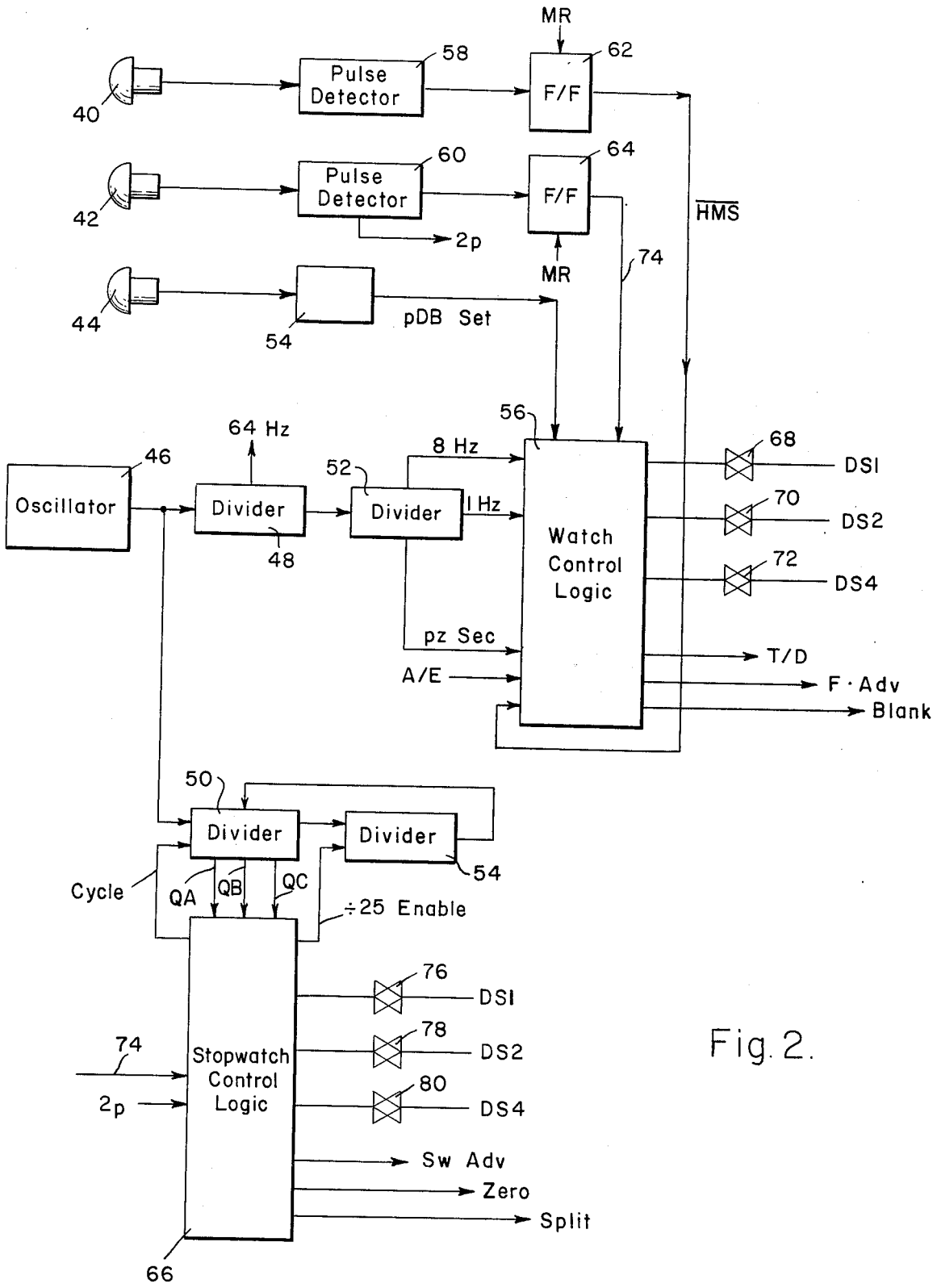
FIG. 2 is a block diagram of the watch push buttons, the watch control logic and the stopwatch control logic.

FIG. 2 is a block diagram showing the oscillator, divider, watch and stopwatch control logic, and pushbutton portions of the electronic circuitry and logic for the digital watch/stopwatch. Electronic oscillator 46 is crystal-controlled to oscillate at a predetermined and substantially constant frequency. The output from crystal-controlled oscillator 46 is driven into standard CMOS dividers 48 and 50 whose outputs are driven into dividers 52 and 54, respectively. The output from divider 52, predetermined clock pulses are delivered to watch control logic 56. Pushbutton 40 is connected to pulse detector 58 which detects if pushbutton 40 has been depressed three times within 2 seconds. Likewise, pulse detector 60 detects whether pushbutton 42 has been depressed two or three times within 2 seconds. Toggle flip-flop 62 changes state when pulse detector 58 detects the correct pulse sequence. Likewise, toggle flip-flop 64 changes state when pulse detector 60 detects the correct pulse sequence. Pushbutton 44 is connected to edge detector 54 which delivers a pulse to the watch control logic 56 whenever pushbutton 44 is depressed.

In operation, when pushbutton 40 is depressed, this fact is conveyed to the watch control logic 56 which sends the correct and necessary timing information to the watch counterselect logic 74 to send the date and month and A.M./P.M. information to the units-tens multiplexer 116 in the in the proper time relationships. Timing information is also sent to the 1 of 6 decoder 80 to select the proper display 22–32 to connect to the output of the seven-segment decoder 78. When pushbutton 42 is depressed, the watch is placed either in the watch or the stopwatch mode depending upon the number of times pushbutton 42 is depressed. If pushbutton 42 is depressed two times pulse detector 60 sends out a signal 2p to the stopwatch control logic 66. The American/European (A/E) input to watch control logic 56 determines whether the horological information is displayed as month/date or as date/month. Watch control logic 56 creates the control logic used in multiplexing the seconds, minutes, hours, day, and month information displayed on the display devices; i.e., watch control logic 56 selects which horological information is to be displayed and on which of the display elements 22–32 it is to be displayed on. Transmission gates 68, 70 and 72 allow the multiplexing information from the watch control logic 56 to be delivered to the watch counter select logic 74, the stopwatch counter select logic 76, the seven-segment decoder 78 and to the 1 of 6 decoder 80. These DS1, 2 and 4 outputs from watch control logic 56 provide the master timing sequence for the counter's information transfer to the display devices 22–32. The time/date output from watch control logic 56 tells watch counter select logic 74 to slew or display the time/date information. The fast advance (F ADV) output from the control logic 56 is used as the slew or setting clock for the chosen counter. Finally, the blank output from watch control logic 56 blanks the display when the set button 44 is depressed so only the decade counter being slewed is displayed. It is also used for lead zero blanking on hours, month and date. Output pZ sec delivers a pulse to divider 52 that zeros the seconds counter when the pushbutton 40 is first depressed when in the set minutes mode.

When pushbutton 42 is depressed three times within two seconds, a signal via line 74 is delivered to stopwatch control logic 66 which enables said logic instead of the watch control logic 56. When stopwatch control logic 66 which operates in a similar manner to watch control logic 56 is enabled, transmission gates 76, 78 and 80 deliver the information from control logic 66 to the stopwatch counter select logic 76, the seven-segment decoder 78 and to the one of six decoder 80. Control logic 66 also outputs a signal stopwatch advance (SW ADV) which is a 1/100 second pulse repetition rate pulse to advance the 1/100 second stopwatch counter. The zero output from control logic 66 resets the stopwatch counters and the split output from control logic 66 goes high when the stopwatch is in the split mode (as described above).

Watch counter select logic 74 consists of a plurality of gates which resets seconds counter 82, tens-of-seconds counter 84, slews and/or resets minutes counter 86, tens-of-minutes counter 88, hours counter 90, tens-of-hours counter 92, date counter 94, tens-of-date counter 96, months counter 98 and tens-of-months counter 100 during the time setting mode depending upon which pushbuttons are depressed. The 12/24 hour input to counter select logic 74 is manufacturer selectable to be a 12 hour or 24 hour watch.

Stopwatch counter select logic 76 consists of a plurality of dates as does watch counter select logic 74. Counter select logic 76 advances, stops and/or resets counter 1/100 seconds counter 102, 1/10 seconds counter 104, seconds counter 106, tens-of-seconds counter 108, minutes counter 110 and tens-of-minutes counter 112. S1 HR output from divide by 2 114 which is driven by the stopwatch minutes counter 112 counts the even/odd hours.

Units-tens multiplexer 116 multiplexes counters 82, 86, 90, 94, 98, 102, 106, 110 with counters 84, 88, 92, 96, 100, 104, 108, 112, thereby providing an initial multiplexing to reduce the system's complexity.

Seven-segment decoder 78 is a device which receives binary coded decimal signals from the units-tens multiplexer 116 and emits seven segments which represent the digits corresponding to the counters state, which are displayed on liquid crystal devices 22–32.

One of six decoder 80 tells the watch which of the display devices gets the digital information. Center symbol control logic 118 determines which of the center symbols 34–38 are displayed. AC generator 120 supplies the AC power required by the liquid crystal display devices 32–38.

Although the device which has just been described appears to afford the greatest advantages for implementing the invention, it will be understood that various modifications may be made thereto without going beyond the scope of the invention, it being possible to replace certain elements by other elements capable of fulfilling the same technical functions therein.

What is claimed is:

1. A resettable interval timer in combination with, but functioning independently from a digital watch which provides horological information comprising:

a plurality of push buttons;

a crystal oscillator;

a first and second divider connected to said oscillator for dividing the pulses from said oscillator;

first counting means for providing inputed coded horological information;

second counting means for providing inputed coded interval timing information;

a plurality of display devices for displaying said horological and said interval timing information;

watch control logic means connected to said first divider for multiplexing said horological information to predetermined display device depending upon the sequence in which said push buttons are depressed;

stopwatch control logic means connected to said second divider for multiplexing said interval timing information to predetermined display devices depending upon the sequence in which said push buttons are depressed;

pulse detection means connected between said push buttons and said watch and stopwatch control logic means for detecting a predetermined number of push button depressions within a predetermined time period;

watch counter select logic means connected between said watch control logic means and said first counting means for slewing and advancing said horological information in said first counting means;

stopwatch counter select logic means connected between said stopwatch control logic means and said second counting means for controlling the starting, stopping and resetting of said interval timing information;

a seven-segment decoder connected between said watch control logic, stopwatch control logic, first and second counting means and said display devices for converting the inputed coded information into seven-segment information which is delivered to said display devices.

2. A combination timer and time keeping digital watch as recited in claim 1, wherein:

said horological information being hours, minutes, seconds, date month, A.M., P.M. and said interval timing information being odd/even hours, minutes, seconds, tenths and hundredths of seconds;

when no push buttons are depressed in the watch mode the hours, minutes and seconds information is displayed on said display devices;

when said first push button is depressed once within a predetermined time period the month, date and A.M. or P.M. information is displayed on said display devices;

when said first push button is depressed three times within a predetermined time period the hours, minutes and date information is displayed on said display devices instead of hours, minutes, seconds;

when said second push button is depressed three times within a predetermined time period said display devices display the interval timing information;

simultaneous depression of said first and second push buttons causes said display devices to be reset to all zeros when in said stopwatch mode;

depression of said first push button after three depressions of the second push button causes the interval timer to begin to count, a subsequent depression of said second push button causes the interval timing information to be frozen on said display devices, still a subsequent depression of said second push button within a predetermined time period from said second depression causes said display devices to display the advancing interval timing information;

depression of said first push putton will cause the interval timer to stop counting and display the current state of the interval timer.

* * * * *